US005570495A

United States Patent [19]

Mogell

[11] Patent Number: 5,570,495

[45] Date of Patent: Nov. 5, 1996

[54] DECORATED LUGGAGE AND METHOD

[75] Inventor: Robert B. Mogell, Voorhees, N.J.

[73] Assignee: Toppers, Inc., Thorofare, N.J.

[21] Appl. No.: 241,166

[22] Filed: May 10, 1994

[51] Int. Cl.[6] ..... B21D 39/03; B23P 19/00; A45C 13/08; A45C 13/42

[52] U.S. Cl. ..... 29/428; 29/426.1; 150/103; 190/113; 190/903; 112/475.08

[58] Field of Search ..... 29/445, 426.1, 29/515, 428; 112/266.1; 190/102, 103, 105, 119, 113, 903; 150/103–105

[56] References Cited

U.S. PATENT DOCUMENTS

| | | | |
|---|---|---|---|
| 1,573,201 | 2/1926 | Steiner | 112/266.1 |
| 2,985,265 | 5/1961 | Gehrie . | |
| 3,040,332 | 6/1962 | Kleinwald | 112/266.1 X |
| 3,165,827 | 1/1965 | Stollman | 29/445 |
| 3,737,980 | 6/1973 | Kotkins | 29/445 X |
| 3,999,639 | 12/1976 | Walters | 190/102 |
| 4,210,230 | 7/1980 | Weiner . | |
| 4,325,315 | 4/1982 | Totino et al. | 112/266.1 |
| 4,472,870 | 9/1984 | Kotkins, Jr. | 29/445 |
| 4,598,802 | 7/1986 | Abenaim . | |
| 4,748,920 | 6/1988 | Stutznacker | 112/266.1 |
| 4,756,394 | 7/1988 | Cohen . | |
| 4,846,319 | 7/1989 | Sadow | 190/105 |
| 4,932,345 | 6/1990 | Takenoya et al. | 112/266.1 |
| 5,144,899 | 9/1992 | Allen | 112/266.1 X |

FOREIGN PATENT DOCUMENTS

| | | | |
|---|---|---|---|
| 2629794 | 10/1989 | France | 150/103 |
| 1532840 | 7/1969 | Germany | 190/103 |
| 2260894 | 5/1993 | United Kingdom | 150/105 |

*Primary Examiner*—Sue A. Weaver
*Attorney, Agent, or Firm*—Howson and Howson

[57] ABSTRACT

A suitcase having a panel portion which can be completely removed from the remaining side and rear panels of the suitcase structure for receiving a design in automated machinery and subsequently being re-attached. A method of manufacture is also disclosed.

2 Claims, 2 Drawing Sheets

DECORATED LUGGAGE AND METHOD

FIELD OF THE INVENTION

The present invention relates to suitcases having decorated designs, and more particularly, the present invention relates to improvements in suitcases to facilitate the embroidering and silk screening of designs on their front panels by a novel method.

BACKGROUND OF THE INVENTION

It is conventional practice to embroider or silk screen designs, such as logos, on a wide variety of articles, such as soft-luggage type suitcases. The design can be used either for decoration, personal identification, commercial exploitation, or a combination of these functions. Articles which are seen commonly by many people can be used commercially to advertise or promote a commercial name, product or design. Suitcases accomplish this goal very well, since they are seen by many people in public while travelling.

Conventional suitcase structures include front and back panels which are integrally connected to each other by a side panel which extends along their peripheries. To apply a design on such a structure, the portion of the suitcase which is not being embroidered or silk screened often interferes with the design applying machinery and therefore slows the process or makes it impossible to apply the design.

With this in mind, the cost of embroidering or silk screening a commercial quantity of suitcases is higher than desirable because of the handling requirements of the suitcases during the design applying process. For instance, it may be necessary to hand embroider or silk screen the panels of the suitcase, since equipment having appropriate memory capabilities may not be able to accept the entire suitcase structure and perform its function properly. Alternately, the equipment may require manual placement, manipulation, and removal of the entire suitcase structure, thereby slowing down the embroidering process.

Although various methods exist for applying a design on a suitcase front panel, there is a need for a suitcase structure and method which provide the capability of enabling commercial quantities of design bearing suitcases to be manufactured in an economical manner.

OBJECTS OF THE INVENTION

With the foregoing in mind, a primary object of the present invention is to provide a novel suitcase structure which affords efficient application of designs onto panels thereof.

Another object of the present invention is to provide a process of embroidering or silk screening suitcase panels which enables a maximum of machine automation and minimizes manual handling in the process.

A further object of the present invention is to provide embroidered or silk screened luggage capable of being made efficiently in commercial quantities with short turnaround times.

SUMMARY OF THE INVENTION

More specifically, the present invention provides a novel, embroidered or silk screened, article of so-called soft luggage for storing and transporting clothing, documents and the like. The luggage article has both a back wall panel and a front wall panel which are connected together along their peripheries by a side wall. The luggage article is designed such that a design placed either on the front or rear panel can be seen readily by many people, such as travelers.

The improvement in the luggage article comprises a front wall panel which is capable of being completely removed from the other walls of the luggage. The front wall panel is made from a semi-stiff, pliant material capable of being embroidered or silk screened by commercial automated machinery. In addition, the front wall panel has a substantially planar configuration and is completely removably attached to the side wall panel.

The planar configuration of the front wall panel allows it to be removed from the side wall panel of the luggage, embroidered or silk screened in conventional machinery, and then reattached to the side wall.

The front wall panel can be, and preferably is, connected to the side wall of the luggage by means of a zipper. One portion of the zipper surrounds the periphery of the front panel; the other portion is on the periphery of the side wall. The zipper clasp remains on the side wall of the luggage, so that it does not interfere with embroidering or silk screening of the front wall panel. Alternatively, and additionally, the back wall panel can be constructed so as to be removably attached to the side wall, thereby enabling it to be embroidered or silk screened in commercial quantities in an efficient manner.

A method for applying a design on either the front or rear wall panels of a suitcase is disclosed. The steps include obtaining a front wall panel having a substantially planar shape. Then, positioning the front wall panel on a planar work surface of an automated machine transverse to the direction of motion of the design applying mechanism. A further step includes manipulating the planar work surface relative to the design applying mechanism so that the mechanism embroiders or silk screens a predetermined design onto the front wall panel. Finally, the front wall panel is removed from the machine and reattached to the side wall of the luggage. This process allows for a commercial quantity of front wall panels having identical predetermined designs to be produced relatively efficiently.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF PREFERRED EMBODIMENT AND METHOD

Figure 1:
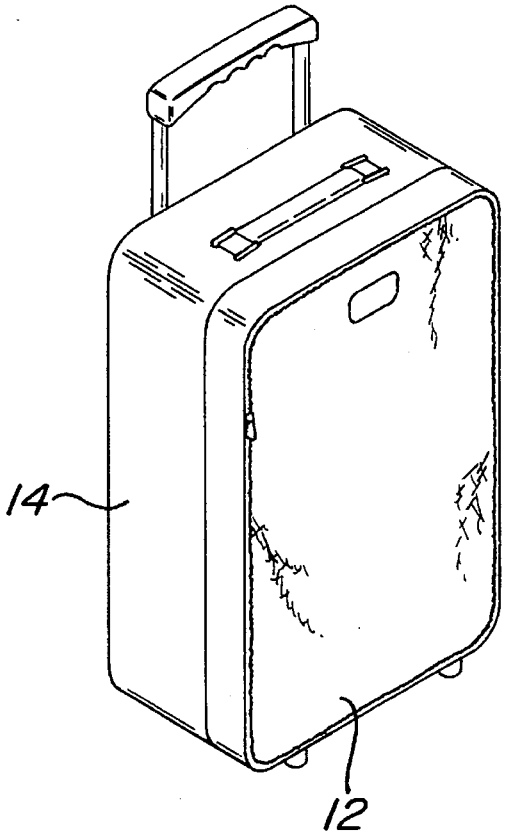
FIG. 1 is a perspective view of a typical soft-luggage-type of suitcase structure.

Referring now to the drawings, FIG. 1 illustrates a so-called soft-luggage suitcase structure 10 which one may use to store and transport clothing, documents and like articles. This type of structure is often used by travelers and is therefore seen in airports, bus stations and like modes of transportation by many people. Such a structure is particularly suited for displaying a design, name or other form of identification for personal or commercial use.

An advertisement or promotion placed on such a suitcase can provide one with a means of displaying information to a large number of people at a relatively low cost, provided the design can be applied efficiently on the suitcase structure in commercial quantities. Often, merchandize such as that shown in FIG. 1 can be given to individuals as promotional items thereby allowing the individual to use the article to advertise a product displayed in the design.

The basic structure of a conventional suitcase 10 is known in the art. Such a structure consists of a front wall panel 12, a back wall panel (not shown), and a side wall 14 which extends along the front and rear wall panel peripheries to connect the front and back wall panels and form a space therebetween. Often, either the front, or the back, wall panel has a means affording at least partial opening to allow access to the articles contained in the space within the luggage, or suitcase.

Figure 2:
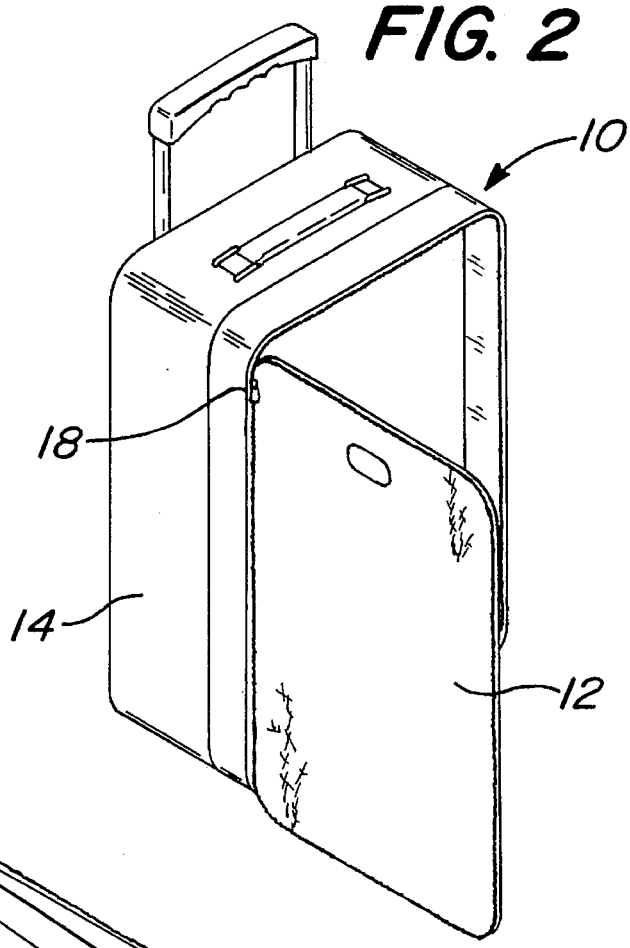
FIG. 2 is a perspective view of a suitcase front wall panel which is capable of being completely removed from the remaining suitcase structure.

FIG. 2 shows a suitcase 10 having a side wall 14 and a front panel 12. The front panel 12 is completely removably connected to the side wall 14 along its periphery and the periphery of the side wall panel 14. While the back panel is not shown in FIG. 2, it is constructed similarly to that of front panel 12 and secured to the side wall panel 14.

One embodiment of the novel design of suitcase 10 as shown in FIG. 2 has a front panel 12 which is connected to the side wall 14 by a zipper 16. The zipper 16 has one component which extends around the entire periphery of the front wall panel 12, and another component which extends around the entire periphery of the side wall panel 14. The zipper allows the front wall panel 12 to be completely removed from the side wall panel. Preferably, the zipper clasp 18 remains with the side wall of the suitcase.

When the front wall panel 12 is removed from the side wall panel 14, it is planar in configuration. In other words, it does not have anything projecting laterally. The front panel is made of a material which is semi-stiff and pliant, and yet can be embroidered or silk screened.

Figure 3:
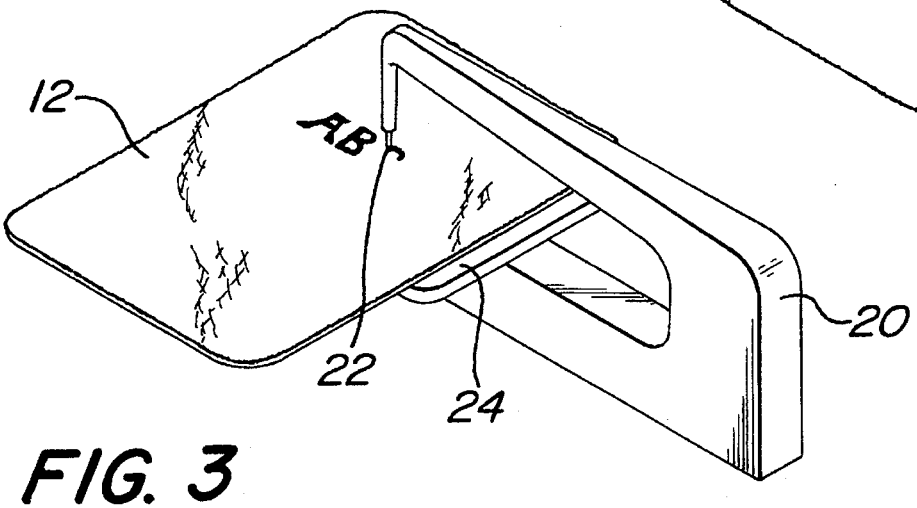
FIG. 3 is a perspective view showing an embroidering machine embroidering a design on a front wall panel.

FIG. 3 illustrates the front wall panel 12 in position in an embroidering machine 20. The embroidering machine 20 comprises a needle mechanism 22 and a work surface 24. The front wall panel 12 is located transverse to the needle mechanism 22 so that it can be stitched. The work surface 24 of the embroidering machine enables the front wall panel 12 to be moved easily relative to the needle mechanism 22. By synchronizing the movement of the work surface and the needle mechanism, designs are easily produced by machinery having memorized designs.

Figure 4:
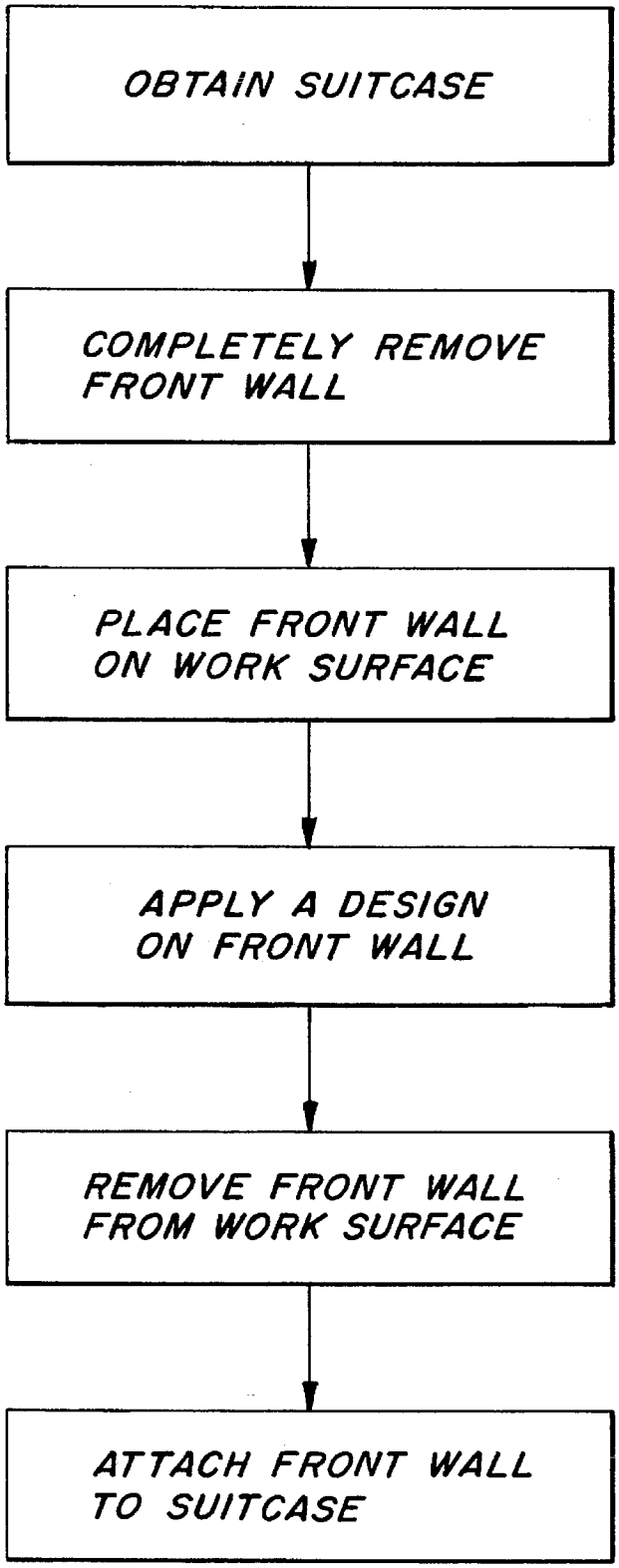
FIG. 4 is a block diagram of a method according to the present invention.

A method of performing an embroidering process as shown in FIG. 4 first involves removing the front panel completely from the remaining suitcase structure. Alternatively, a commercial quantity of just front suitcase panels can be brought to a location where the embroidering machines are located. The front panels can be placed on a work surface of an embroidering machine. The work surface may advance in memorized movements in order for the needle to embroider a design precisely in commercial quantities on the front panel. Alternatively, in some machines, the panel is stationary and the needle moves relative to it. After a commercial quantity of front panels are embroidered, they can be collected and then shipped to a location having the remaining parts of the luggage, i.e. side walls attached to rear walls. The embroidered front panels can then be reattached to their companion structures.

The above suitcase structure and method of embroidering provides an economical way to provide commercial quantities of embroidered suitcases.

Alternate design applying processes can be utilized. For instance, the design can be silk screened onto a panel utilizing silk screening machinery known in the art.

While a preferred embodiment of the present invention and method has been described in detail, various modifications, alterations, and changes may be made without departing from the spirit and scope of the present invention as defined in the appended claims.

I claim:

1. A method for applying a design on a suitcase having a back wall and a front wall connected together along their peripheries by a side wall, comprising the steps of:

obtaining the front wall separate from the back and side walls, the front wall having a slide fastener along its periphery for removably connecting the front wall to the side wall, forming an entire structural component of the suitcase for closing and opening the suitcase, being made from a semi-stiff pliant material, and having a substantially planar shape;

disposing said front wall on a planar work surface of a design applying machine and transverse to the direction of a design applying mechanism;

applying a design on said front wall with said design applying machine; and removing said front wall from said machine;

whereby commercial quantities of said front walls having identical pre-determined designs can be produced in a relatively short period of time.

2. A method according to claim 1 further comprising the step of attaching said front wall to the side wall after said front wall is removed from said machine.

* * * * *